United States Patent [19]

Kaveney, Jr.

[11] 4,371,205

[45] Feb. 1, 1983

[54] DOOR LOCK

[75] Inventor: John R. Kaveney, Jr., East Peoria, Ill.

[73] Assignee: Caterpillar Tractor Co., Peoria, Ill.

[21] Appl. No.: 250,753

[22] PCT Filed: Jul. 7, 1980

[86] PCT No.: PCT/US80/00853

§ 371 Date: Jul. 7, 1980

§ 102(e) Date: Jul. 7, 1980

[51] Int. Cl.[3] ..... E05C 3/06

[52] U.S. Cl. ..... 292/48; 70/145; 292/336.3; 292/359

[58] Field of Search ..... 292/48, 210, 216, 280, 292/336.3, 359, DIG. 24, DIG. 25, 196, 223, 48; 70/145

[56] References Cited

U.S. PATENT DOCUMENTS

| | | | |
|---|---|---|---|
| 1,908,958 | 5/1933 | Coffron | 292/1 |
| 2,682,763 | 7/1954 | Williams | 292/175 X |
| 2,791,459 | 5/1957 | Roethel | 292/DIG. 24 |
| 3,140,888 | 7/1964 | DiSalvo | 292/48 |
| 3,232,656 | 2/1966 | Coverley et al. | 292/280 |
| 3,312,489 | 4/1967 | Trudeau | 292/48 |
| 3,361,462 | 2/1966 | Foster | 292/165 |
| 4,049,305 | 9/1977 | Zetterlund et al. | 292/336.3 |
| 4,216,985 | 8/1980 | Sorensen | 292/336.3 |
| 4,277,964 | 7/1981 | Crabb et al. | 292/153X |

*Primary Examiner*—Richard E. Moore

*Attorney, Agent, or Firm*—Wegner, Stellman, McCord, Wood & Dalton

[57] ABSTRACT

A vehicle door lock (201) and latch (204) assembly is provided whereby a key may be used to lock the door (200) and to prevent rotation of the outside door handle (214). An inside door handle (202) is provided remote from the lock assembly (201) and connected thereto by a linkage (216,232,246) which enables the inside handle (202) to operate the lock assembly (201) by overridng the key lock (308). The inside handle (202) can move the linkage to open the door (200) and lock or unlock the lock assembly (201). The outside handle (214) can open the door (200) only if the lock assembly (201) is unlocked. The lock assembly (201) may be unlocked from the outside only by turning the key in the lock (308) to the unlocked position.

10 Claims, 7 Drawing Figures

FIG. 7
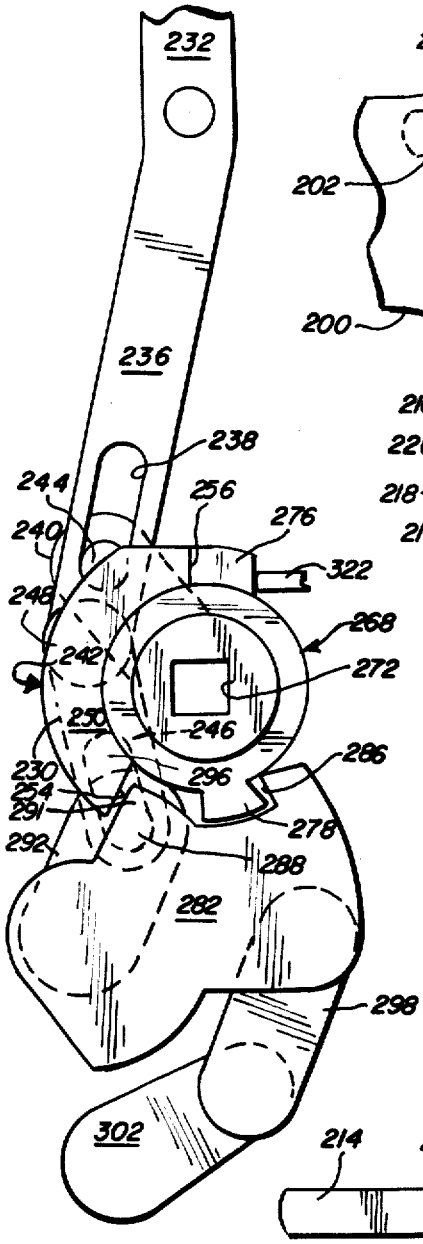
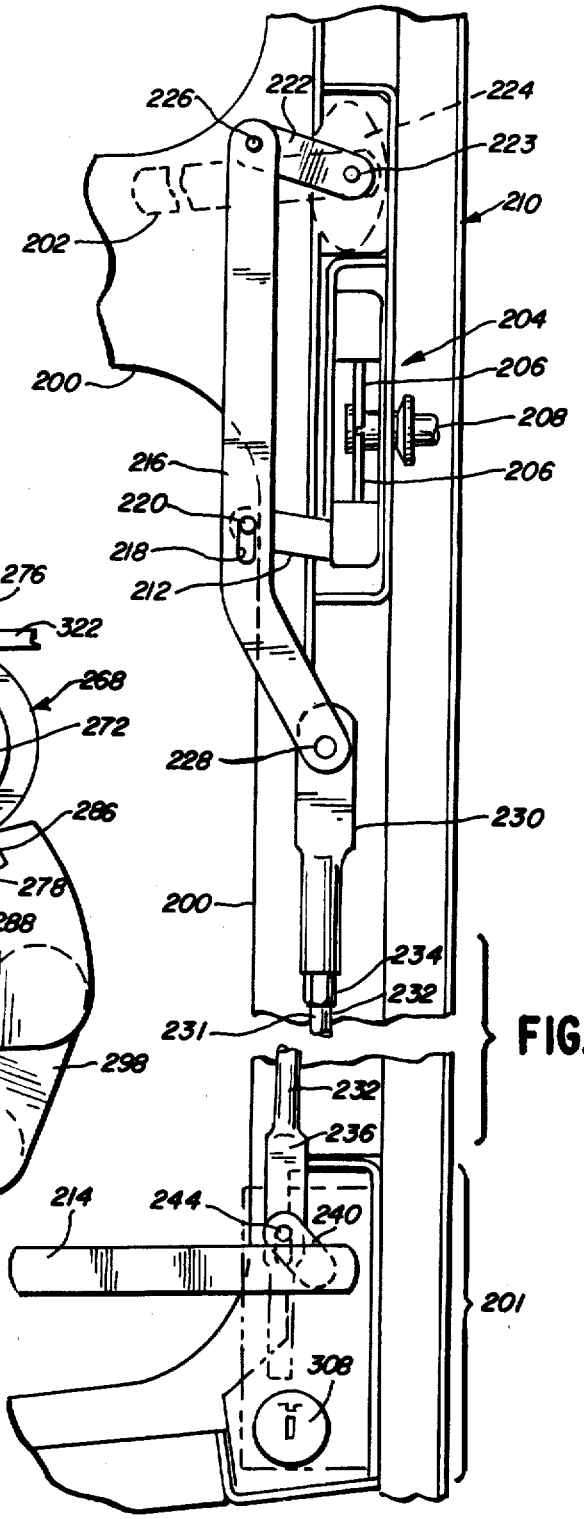
FIG. 1

DOOR LOCK

DESCRIPTION

1. Technical Field

This invention relates to door locks and, more particularly, to a door lock having a lock release apparatus operative by a pair of handles, one of which is remote from the locking mechanism and outside of the door, and the other of which is inside of the door.

2. Background Art

Some current doors for cabs, for instance, on tractors for bulldozers and the like, are locked from the outside using a key. The locks on some doors are such that they cannot be unlocked or operated from inside the cab when key locked from the outside.

There are some locks which are key locked on one side and have a mechanism on the other side for unlocking. For example, U.S. Pat. No. 2,682,763, issued to Williams on Jul. 6, 1954, shows a door latch which is key locked from the outside but has a mechanism on the inside which can be actuated on the inside to release the latch. Also, U.S. Pat. No. 1,908,958, issued to Coffron on May 16, 1933, shows a door latch which can be released from the inside and can have the bolt disconnected from the outside handles so that the outside handle will turn without moving the bolt. However, because of the size of many pieces of equipment currently having cabs, the handle for opening the lock from both inside and outside of the cab has been high off the ground. Since the locking mechanism has traditionally been close to the inside handle, the result has been that the outside handle has been well above ground level and, thus, difficult, if not impossible, to reach by persons standing on the ground, unless a ladder or other aid is used.

The present invention is directed to overcoming one or more of the problems as set forth above.

DISCLOSURE OF INVENTION

In one aspect of the present invention, a lock and linkage assembly is provided for operating a vehicle door latch. Interior and exterior handles are provided, with one handle being located with the lock assembly at one location and the other handle and latch being remote from the lock assembly and connected thereto by a linkage assembly. The lock assembly contains a cam element movable between locked and unlocked positions. When in the locked position, the cam element prevents the one handle located with the lock assembly from being turned. The other handle may be turned to move the linkage so as to engage the cam element and move it to an unlocked position. When unlocked, either handle may be turned to move the linkage to open the door latch.

A lock, a latch, and a linkage assembly is provided for a vehicle and the like which is operated from the outside and from the inside. The linkage assembly enables one handle to be placed remote from the lock assembly, a feature which is particularly desirable in large vehicles where the interior handle must be placed in a cab at a height far above that convenient to gaining access from the outside, where access is usually gained at ground level. When the lock assembly is locked, it prevents the exterior handle from being turned to open the door latch. The lock assembly may only be opened from the outside by a key. The interior handle may, however, at all times be turned to open the latch. Further, the interior handle can be operated to move the lock assembly to either a locked or unlocked position, in the latter case enabling the exterior handle to be operated to open the door latch.

The improved lock and linkage assembly provides improved operational features. The assembly enables the inside door handle to be located at a level easily reachable by a person in a vehicle cab and at the same time permits a person at the much lower ground level to have easy access to the exterior handle and key lock. The inside door handle may be used to lock, unlock, and unlatch the door. The outside handle may be turned, to unlatch the door only when it is unlocked. A key must be used to lock or unlock the door from the outside. This relatively simple structure provides safety and security and is durable and long lasting.

BRIEF DESCRIPTION OF DRAWINGS

FIG. 1 is a broken away elevational view of the lock, latch and linkage within a door;

FIG. 7 is also similar to FIG. 5 showing the lock mechanism when moved to the locked position by the interior handle.

BEST MODE FOR CARRYING OUT THE INVENTION

Figure 2:
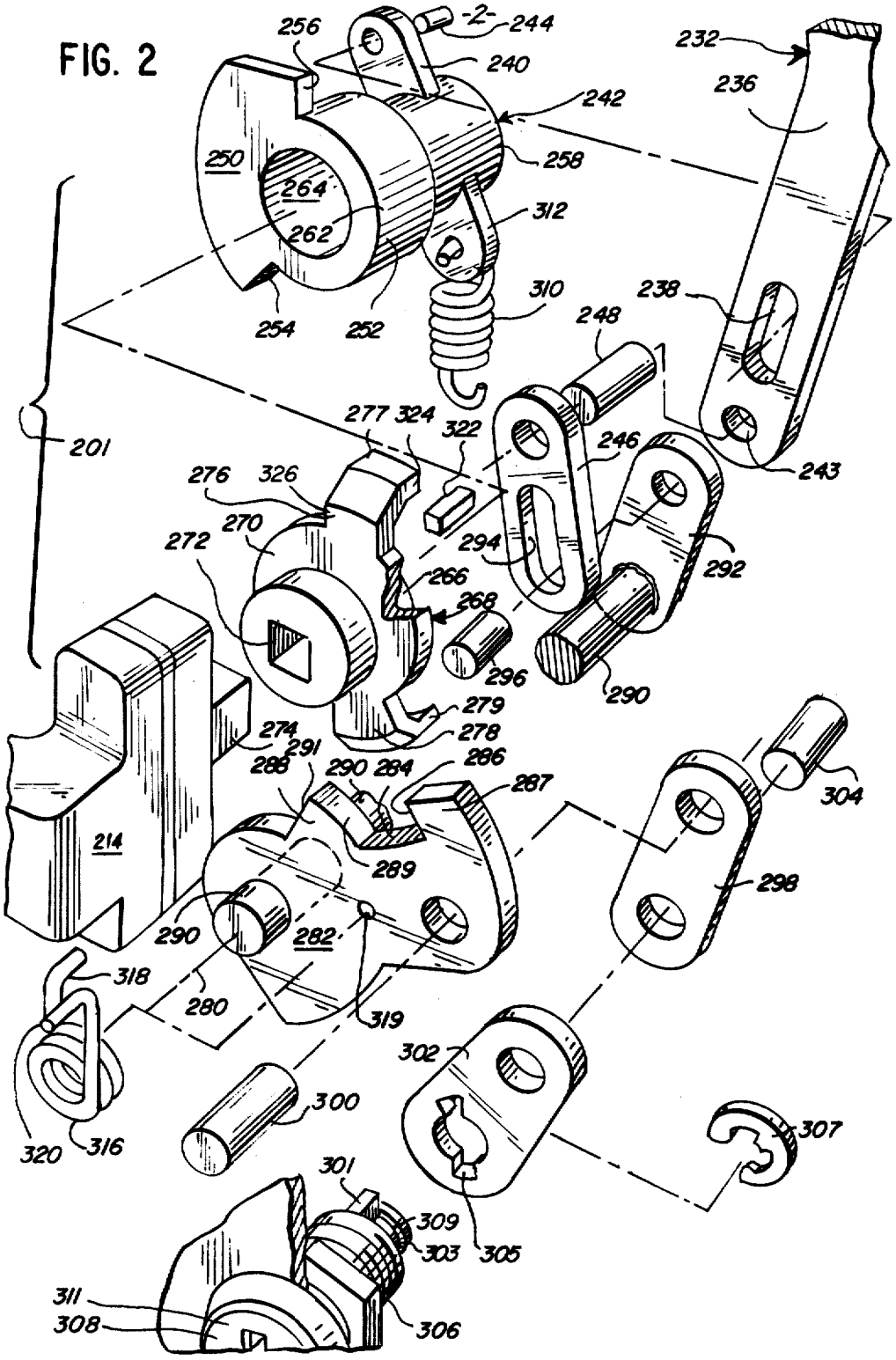
FIG. 2 is an exploded view of the lock mechanism.

A linkage in an equipment cab door 200 for connecting two remote handles to a single lock with operational features as described above is detailed in FIG. 1. This mechanism is ideal for large machinery since the lock mechanism 201 has an exterior handle 214 extending through an outside panel 203 and may be placed at a height accessible to a person standing on the ground while a remote interior handle 202 extending through an inside panel 205, which also operates the locking mechanism, may be located in the machinery cab well above the actual lock mechanism 201.

The latch, shown generally at 204, may be any conventional type latch, the one shown having jaws 206 which open and close on a pin 208 secured to the equipment body 210. The latch 204 is actuated by pivoting a lever arm 212. As is hereinafter described, the lever arm 212 may be pivoted by an exterior handle 214 when unlocked and may be pivoted by an interior handle 202 whether locked or unlocked.

A link 216, having a slot 218 therein somewhat remote from either end portions of the link and slidably receiving a pin 220 extending transverse to the latch lever arm 212, is used to actuate the latch 204. The lever arm 212 may be pivoted downward to unlatch the door by pivoting the interior handle 202 downward. The interior handle 202 is rigidly connected to a link 222 by a solid shaft 223 which is part of handle 202. The interior handle 202 pivots within a mounting plate 224 which is mounted to the door 200. The opposite end of the link 222 is pivotably connected by a pin 226 to the link 216. When the interior handle 202 is pivoted downward, it causes the link 216 to move axially downward and the pin 220 on the lever arm 212 slides within the slot 218 until it abuts the upper end of the slot 218 so that further downward movement of the link 216 causes the lever arm 212 to pivot downward and unlatch the door. The link 216 may also be caused to move axially upward when locking the lock mechanism 201 with the interior handle 202, this operation will be described in detail hereinafter. The slot 218 in the link 216 is long enough to permit the upward motion of the link 216 without binding the pin 220 in the lower end of the slot 218 or urging the latch lever arm 212 upward.

The lower end of the link 216 is pivotably connected by a pin 228 to a rod end 230 of a rod 232. The rod end 230 is axially adjustable relative to a flat opposite end 236 of the rod 232 by means of a threaded shank 231 threading into the rod end 230 and being locked in a selected position by a nut 234. The rod 232 extends to the lock mechanism 201 thereby connecting the exterior handle 214 to the latch 204 and the interior handle 202 to the lock mechanism 201 to provide the operational features described below.

The flat end 236 of rod 232 is connected to the lock mechanism 201 as best shown in FIG. 2. The flat portion 236 of the rod 232 has an axially extending slot 238 near its lower end which is slidably and pivotably connected by a pin 244 to an extending leg 240 on a bellcrank 242. The extreme lower end of the rod 232 has an aperture 243 receiving a pin 248 which pivotally connects the rod to a lock link 246. The pins 244,248 may be held in place by any conventional means, one such means being a cotter key or a retaining clip.

Figure 3:
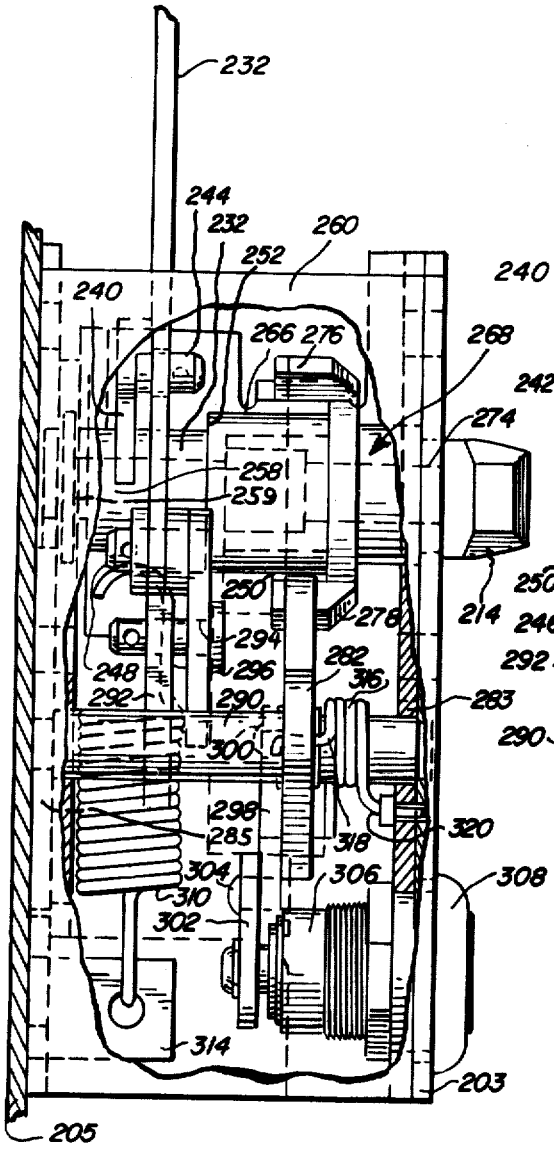
FIG. 3 is a side view of the lock mechanism with the housing partially broken away.

The bellcrank 242, at one front axial end 262, has an outwardly extending integrally formed segment of a collar 250 extending from a body portion 252 and has, at each end of the segment, abutments or contact surfaces 254,256, at least one of which surfaces 256 lies along a radius extending through the axis of the body portion 252. The other axial end 258 of the bellcrank 242 is pivotally secured within a lock housing 260 (FIG. 3) by a shaft 259 projecting into the housing 260 so that the body 252 pivots in housing 260 on its axis. The front axial end 262 of the bellcrank 242 has a cylindrical opening 264 in which a matching projection 266 on the rear of the lock ring 268 is received to ensure that the lock ring 268 and bellcrank 242 pivot around the same axis.

The lock ring 268 has a body portion 270 through which a square aperture 272 extends. The aperture 272 is adapted to receive a square end portion 274 extending into the lock mechanism from the exterior handle 214 so that rotation of the exterior handle 214 will rotate the lock ring 268. The body portion 270 of the lock ring 268 also has a pair of radially opposed tabs 276,278 with axially extending portions 277,279. The axially extending portions 277,279 of the tabs 276,278 and the collar 250 of the bellcrank 242 lie in a plane extending transverse to the axis of the lock ring 268 when the bellcrank 242 and lock ring 268 are assembled together. The radii of the axially extending portions 277,279 and the radii of the contact surfaces 254,256 are substantially equal.

Figure 4:
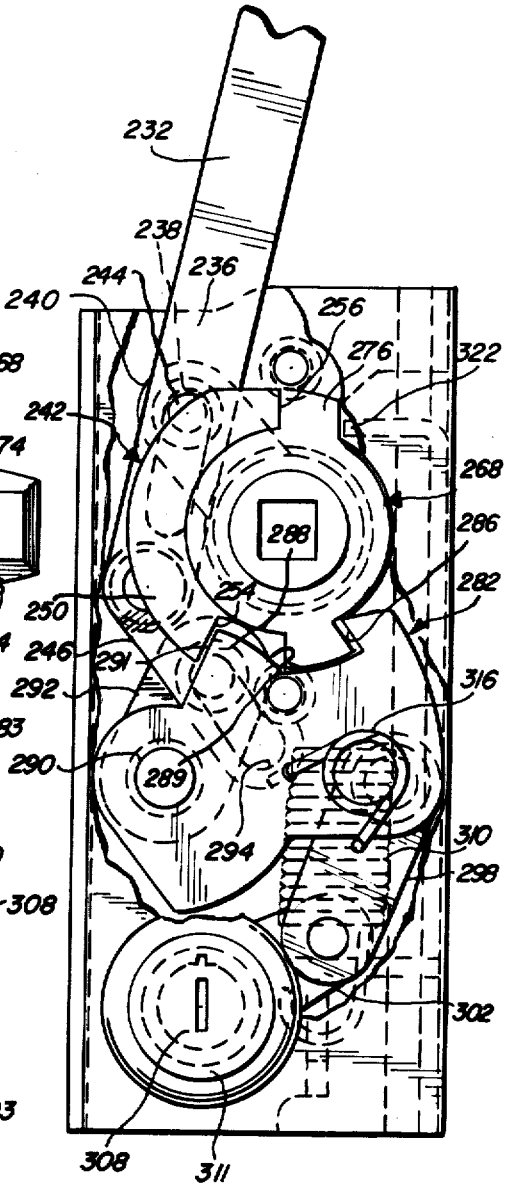
FIG. 4 is a plan view of the lock mechanism with the housing partially broken away, the lock mechanism being shown in the locked position.

A locking cam 282 is fixed on a pivot shaft 290 (FIG. 3) which is pivotally mounted in the front and rear sides 283,285 of the housing 260. The locking cam 282, which pivots about the axis 280 of the shaft 290, is axially parallel to the bellcrank 242. The locking cam 282 has a notch 284 for receiving the lock ring tab 278. The outer end of the notch 284 is defined by a projection 287 having a locking surface 286 which faces the axis 280 of the locking cam 282 and lies on a radial line extending from the axis of the lock ring when the locking cam 282 is in a locking position as shown in FIG. 4. The inner end of the notch 284 is defined by a triangular projection 288 having a cam surface 289 facing the locking surface 286 and a radially directed surface 291 which abuts one contact surface 254 of the latch ring collar 250.

The locking cam 282 pivots with the shaft 290, which shaft 290 has an outwardly extending arm 292 affixed thereto in spaced apart relationship to said cam 282. When the arm 292 is pivoted, the shaft 290 and locking cam 282 will be pivoted. The outer end of the arm 292 is slidably and pivotably connected to the lock link 246 by a rivet 296 extending from the arm 292 into a slot 294 in said link 246.

The locking cam 282 is pivotably connected at its one end to a link 298 by a rivet 300, the other end of this link 298 being pivotably connected to another link 302 by a rivet 304. The latter link 302 has a butterfly opening 305 which receives a bar 301 mounted on a lock shaft 303 extending from the barrel 306 of the key lock mechanism 308. The link 302 is held assembled with the shaft 303 by a snap ring 307 seating in a groove 309 in said shaft 303. Key lock mechanism 308 is conventional and has a slotted disc 311 exposed to the exterior of the equipment as shown in FIGS. 1 and 2 for receiving a key therein. Turning the key in the lock mechanism 308 will pivot the shaft 303 and link 302 to lock or unlock the latch 204 as will be described hereinafter.

A spring 310 is connected at one end on a second outwardly extending arm 312 on the bellcrank 242 and is connected at the other end to a tab 314 (FIG. 3) secured to side 285 of the housing 260. The spring 310 is in tension and, thus, biases the bellcrank 242 in a clockwise direction as viewed in FIG. 2.

A coil spring 316 has one leg 318 connected off center in an aperture 319 in the locking cam 282 and has the other leg 320 connected to the front side 283 of the housing 260. The spring 316 is mounted between the locking cam 282 and the housing 260 so that its extending legs 318,320 are tensioned together, biasing the locking cam 282 either toward its locking position or toward its unlocking position, the direction of the bias depending upon the location of the locking cam 282. The spring 316 changes its direction of bias on the locking cam 282 at the position where the point of connection of the leg 318 on the locking cam 282 lies on the plane defined by the locking cam axis 280 and the point of connection of the leg 320 to the housing. This position is approximately half way between the extreme positions for locking and unlocking.

Also shown is a stop 322 carried by the housing 260 which engages one side 324 of the axial portion 277 of the lock ring tab 276 to limit clockwise rotation of the lock ring 268 (as viewed in FIG. 2). Since one end surface 256 of the collar 250 on the bellcrank 242 abuts the other side surface 326 of the axial portion 277 of lock ring tab 276, the lock ring 268 is urged by bellcrank 242 against the axial portion 277 which urges the axial portion 277 against stop 322 to limit clockwise rotation of the bellcrank 242.

INDUSTRIAL APPLICABILITY

The improved lock and linkage assembly enables an operator within the equipment cab to manipulate the interior handle 202 to unlatch the door 200 and lock or unlock the lock mechanism 201. A person outside the equipment at ground level may use the exterior handle 214 to open the door 200 only when it is unlocked. The door 200 may be unlocked from the outside only by insertion of the proper key within the key lock mechanism 308.

Operation of the exterior handle 214 is as follows. Since the exterior handle 214 pivots with the lock ring 268, the handle 214 will not turn when the locking cam 282 is in the locked position as shown in FIG. 4. The contact of the axial portion 277 of tab 276 against the stop 322 prevents clockwise movement of the lock ring 268. The locking surface 286 of the notch 284 in the locking cam 282 abuts the other tab 278 of the locking ring 268 to prevent counterclockwise movement of the lock ring 268.

Figure 5:
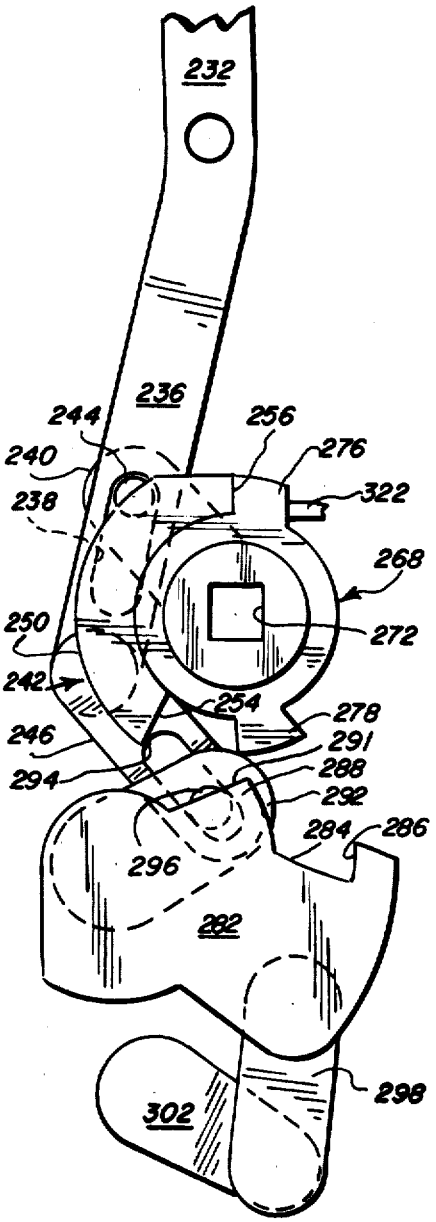
FIG. 5 shows the working components of the lock mechanism in the unlocked position.

To unlock the lock mechanism 201 from the outside, a key may be inserted into the key lock mechanism 308 and turned clockwise. This causes the bar 301 and shaft 303 to turn within the butterfly opening 305, engaging the surfaces of that opening to pivot the link 302 clockwise. This motion causes the attached link 298 to pull on the locking cam 282 and pivot it clockwise to the unlocked position (FIG. 5). To lock the mechanism from outside, merely the reverse is done with the key turned counterclockwise.

When the locking cam 282 is in its unlocked position, the exterior handle 214 may be pivoted downward (counterclockwise). This causes the lock ring 268 to pivot counterclockwise and, since the side surface 326 of the top tab 276 on the lock ring 268 engages one contact surface 256 on the collar 250 on the bellcrank 242, the bellcrank 242 pivots counterclockwise with the lock ring 268. This movement causes the first outwardly extending leg 240 on the bellcrank 242 to move downward until the pin 244 attaching it to the rod 232 engages the bottom end of the slot 238 in the rod 232. Further pivoting of the exterior handle 214 causes the outwardly extending leg 240 and pin 244 to pull down on the flat end 236 of rod 232, causing the link 216 to pull down on the lever arm 212 of the latch 204, opening the latch 204.

Figure 6:
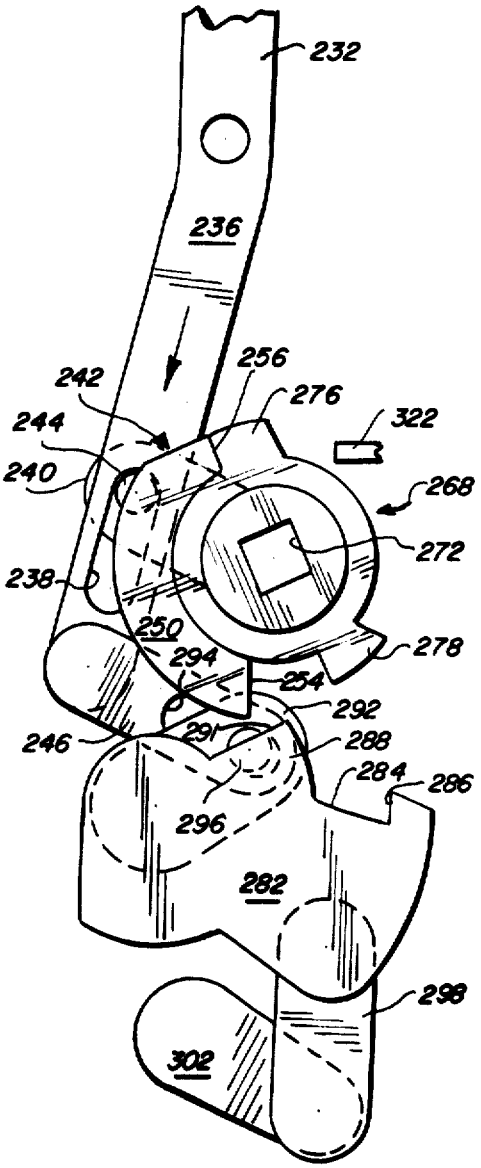
FIG. 6 is similar to FIG. 5 showing the components in the position occupied when the lock mechanism is unlocked by the interior handle.

With the lock mechanism 308 in the key locked position, the interior handle operates the lock and linkage in the following manner. By pushing downward on the interior handle 202, the link 216 is forced downward. As already detailed, this causes the lever arm 212 of the latch 204 to pivot downward thereby opening the door. By pivoting the interior handle 202 downward to open the latch 204, the lock mechanism 201 is also opened. By pressing down on the interior handle 202, the link 216 and rod 232 are moved down so that just prior to unlocking, the lock mechanism 201 is in the position shown in FIG. 4 where the pin 244 connecting the rod 232 to the bellcrank 242 abuts the upper end of the slot 238 in the rod 232. Further downward movement of the rod 232 (caused by further downward pivoting of the interior handle 202) moves the first outwardly extending leg 240 of the bellcrank 242 so that the bellcrank 242 rotates counterclockwise. This counterclockwise rotation forces the leading edge 254 of the collar 250 on the bellcrank 242 to apply contact pressure against the radially directed surface 291 of the projection 288 on the locking cam 282, causing the locking cam 282 to pivot clockwise to ride the cam surface 289 of projection 288 against the edge of tab 278 until the locking cam 282 reaches a point where the attached end of its coil spring 316 goes beyond the plane passing through the locking cam axis 280 and the point where the spring 316 is connected to the housing 260. When the locking cam 282 passes that point, the spring 316 then acts to bias the locking cam 282 clockwise into its unlocked position (as shown in FIG. 6). When the interior handle 202 is then released, the tension spring 310 on the bellcrank 242 moves the bellcrank 242 clockwise against lock ring tab 276 which, in turn, moves clockwise until that motion is prevented by the stop 322 (as shown in FIG. 5).

In order to lock the lock mechanism 201 with the interior handle 202, the handle 202 is pulled upward beyond the horizontal position. This causes the link 222 and link 216 (FIG. 1) to move the slot 218 in the link 216 upward relative to the pin 220 preventing the latch lever arm 212 from interfering with the motion of the link 216. The link 216 pulls rod 232 to move slot 238 relative to pin 244 on leg 240 of bellcrank 242 so that the bellcrank 242 does not interfere with the movement of the rod 232. The pin 248 on the lower end of the rod 232 pulls upward on the link 246 which, when the rivet 296 in slot 294 reaches the lower extreme of the slot 294, will pivot the arm 292, the affixed shaft 290 and the locking cam 282 in a counterclockwise direction until the spring 316 goes overcenter whereupon the spring 316 will urge the locking cam 282 counterclockwise until the notch 284 engages over the ring tab 278 on the lock ring 268 to place the locking cam 282 in the locked position (see FIG. 7).

The pin and slot connections between the rod 232, bellcrank 242, link 246, arm 292 and locking cam 282 must be of such a size and must be so arranged that the biasing operation of one is not interfered with by the other. Thus, when the pin 244 and slot 238 associated with the bellcrank 242 are pushing down to open the lock mechanism 201, as detailed above, the rivet 296 and slot 294 do not prevent the locking cam 282 from pivoting. Similarly, when the rivet 296 and slot 294 associated with the locking cam 282 pull the locking cam 282 to its locked position, the pin 244 and slot 238 associated with the bellcrank 242 do not prevent the rod 232 from moving up as necessary. Finally, when the bellcrank 242 is pivoted by the exterior handle 214 to open the latch 204, the downward pull on the rod 232 by the bellcrank 242 is not hindered by the rivet 296 and slot 294 associated with the locking cam 282. A slot and link configuration proportionally sized to exhibit the above features can be seen in the figures.

Other aspects, objects and advantages of this invention can be obtained from a study of the drawings, the disclosure and the appended claims.

I claim:

1. A lock and linkage assembly for a door for a vehicle having a latch structure (204) for latching and locking said door, comprising first and second handle means (214,202) extending outwardly and inwardly from opposite sides of said door, said second handle means (202) being remote from the lock assembly and connected thereto by rod means (216,232), a cam element (282) rotatably mounted in said door, said cam element (282) having one portion (286) engaging with said first handle means (214) for preventing said first handle means (214) from being turned when said cam element (282) is in the locked position, a rotatable bellcrank (242) rotatably mounted in said door and operably connected to said rod means (216,232) and to said second handle means (202), said cam element (282) having a second portion (288) engaging with an abutment (254) on said rotatable bellcrank (242) when said cam element (282) is in said locked position, said second handle means (202) moving said rod means (216,232) and said rotatable bellcrank (242) to move said abutment (254) against said second portion (288) of the cam element (282) to move the first portion (286) of the cam element (282) out of engagement with the first handle means (214) and to move the cam element (282) to the unlocked position, said first and second handle means (214,202) are operative to unlatch the door when said cam element (282) is in the unlocked position.

2. A lock and linkage assembly as claimed in claim 1 wherein said first handle means (214) is an outside handle (214) and said second handle means (202) is an inside handle (202).

3. A lock and linkage assembly as claimed in claim 1 wherein said one portion (286) of said cam element (282) is a cutout (284) forming a wall (286) on a projection (287) from said cam element (282), said first handle means (214) has a tab (278) engaging with said wall (286) to prevent said first handle means (214) from being rotated when said cam element (282) is in the locked position.

4. A lock and linkage assembly as claimed in claim 1 wherein said second portion (288) of said cam element (282) is a projection (288) having a cam surface (289) and a radially directed surface (291), said second handle means (202) being moved to move said abutment (254) into contact with said radially directed surface (291) to move said cam surface (289) against said first handle means (214) thereby moving said cam element (282) to the unlocked position.

5. A lock and linkage assembly for a door of a vehicle having a latch structure (204) for latching and locking said door, said lock assembly comprising a first handle (214) having a lock ring (268) fixed thereon, spaced apart means (276,278) carried by said lock ring (268), rigid stop means (322) extending into position to be contacted by one of said spaced apart means (276, 278), a second handle (202) offset from and extending in a direction opposite to said first handle (214) and reciprocating a linkage (216,232,246) which actuates the latch (204) and rotates a bellcrank (242), said bellcrank (242) being coaxially aligned with said lock ring (268) and being rotatably mounted relative thereto, first spring means (310) for resiliently biasing said bellcrank (242) and linkage (216,232,246) against opening the latch (204), a pair of means (254,256) on said bellcrank (242) with one of said means (256) engaging with one of said spaced apart means (276) on said lock ring (268), locking means (282) pivotally mounted relative to said door, means (286) on said locking means (282) in alignment with one of said spaced apart means (278) on said lock ring (268) when said locking means (282) is in the locked position, second spring means (316) urging said locking means (282) into either a locked or unlocked position, second means (288) on said locking means (282) in contact with one of said means (254) on said bellcrank (242) when said locking means (282) is in the locked position, said locking means (282) in locked position aligns the means (286) on the locking means (282) with one of said spaced apart means (278) on said lock ring (268) to prevent the lock ring (268) and the first handle (214) from being moved in either direction, turning said second handle (202) clockwise will axially move said linkage (216,232,246) to open the latch (204) and also rotate said bellcrank (242) so that the bellcrank (242) moves against said second means (288) on the locking means (282) to pivot the locking means (282) to the unlocked position.

6. A lock and linkage assembly as claimed in claim 5, wherein said linkage (216,232,246) is further connected to said locking means (282) whereby turning the second handle (202) counterclockwise will move said linkage (216,232,246) upward to bias said locking means (282) into a locking position.

7. A lock and linkage assembly as claimed in claim 6, wherein said linkage (216,232,246) comprises a link (216) pivotally secured at its upper end to the second handle (202), at an intermediate point to the latch (204), and at its lower end to a rod (232), said rod (232) connected to a leg (240) on said bellcrank (242) by pin and slot means (244,238) and to a lock link (246) by pin means (248), said lock link (246) is connected to an arm (292) on said locking means (282) by rivet and slot means (296,294), said rivet and slot means (296,294) on said lock link (246) urging said arm (292) and said locking means (282) toward a locking position when said rod (232) is moved upward and said rivet and slot means (244,238) on said rod (232) may either urge one of the means (254) on said bellcrank (242) to pivot the locking means (282) to an unlocked position or be urged by counterclockwise turning of the first handle (214) to move said rod (232) and link (216) to open the latch (204).

8. A lock assembly for a vehicle having a door (200) with an outside panel (203) and an inside panel (205), a latch structure (204) for latching said door (200), and a lock structure (201) for locking said latching structure, said assembly comprising a handle (214) extending through said outside panel (203) and having a lock ring (268) keyed thereon, spaced apart tabs (276,278) projecting from said lock ring (268), stop means (322) carried by said door (200) and extending into position to be contacted by one of said tabs (276) on said lock ring (268), a bellcrank (242) coaxially aligned with said lock ring (268) and rotatably mounted relative thereto, means (216,232) connecting said bellcrank (242) to a latch means (204,212) for unlatching said door (200), said connecting means (216,232) being engaged at its furthest end with a second handle (202) extending through said inside panel (205), spring means (310) for resiliently holding said latch means (204,212) in the latched position, a pair of abutment means (254, 256) on said bellcrank (242) with one abutment (256) of said abutment means (254,256) engaging with said one tab (276) on said lock ring (268), locking means (282) pivotally mounted relative to said door (200), means (284) on said locking means (282) in alignment with the other tab (278) on said lock ring (268) when said locking means (282) is in the locked position, a key lock (308), means (298,302) connecting said locking means (282) to said key lock (308), said last-named means (298,302) having operative means (305) engaging with a portion of the key lock (308) either to selectively operate said key lock (308) or to be selectively operated by said key lock (308), second spring means (316) urging said locking means (282) into either a locked or unlocked position, a cam surface (289) on said locking means (282) in contact with one abutment (254) of the abutment means (254,256) when said locking means (282) is in the locked position, locking said key lock (308) will operate to move said locking means (282) into position to align the means (284) on the locking means (282) with the other tab (278) on said lock ring (268) thereby preventing the lock ring (268) and outside handle (214) from moving in either direction, and turning the second handle (202) clockwise will move the one abutment (254) of the abutment means (254,256) on the bellcrank (242) against said cam surface (289) on the locking means (282) to pivot the locking means (282) and latch means (204,212) to the unlocked and unlatched position.

9. The lock assembly of claim 8, further comprising means (246,292) for linking said locking means (282) to said connecting means (216,232), wherein said connecting means (216,232) may be moved by said second handle (202) to either move said bellcrank (242) to unlock said locking means (282) or move said linking means (246,292) to lock said locking means (282).

10. The lock assembly of claim 9, wherein said connecting means (216,232) comprises a link (216) and rod (232) pivotably connected together, said link (216) being connected to said latch means (204,212), said rod (232) being connected to said bellcrank (242) by pin and slot means (244,238), and said linking means (246,292) being pivotably connected to said rod (232) and connected to said locking means (282) by other rivet and slot means (296,294), and wherein said first and second handles (214,202) when pivoted move said link (216) and rod (232) axially.

* * * * *